US008403471B2

(12) United States Patent
Ito

(10) Patent No.: US 8,403,471 B2
(45) Date of Patent: Mar. 26, 2013

(54) DEFOAMING MECHANISM AND LIQUID EJECTING APPARATUS

(75) Inventor: Hiroyuki Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 404 days.

(21) Appl. No.: 12/551,768

(22) Filed: Sep. 1, 2009

(65) Prior Publication Data

US 2010/0053285 A1 Mar. 4, 2010

(30) Foreign Application Priority Data

Sep. 2, 2008 (JP) ..... 2008-224895
Sep. 2, 2008 (JP) ..... 2008-224900

(51) Int. Cl.
*B41J 2/19* (2006.01)
*B41J 2/175* (2006.01)

(52) U.S. Cl. ..... 347/92; 347/85

(58) Field of Classification Search ..... 347/85, 347/86, 92
See application file for complete search history.

(56) References Cited

U.S. PATENT DOCUMENTS 6,244,695 B1 6/2001 Udagawa
2008/0151026 A1* 6/2008 Kobayashi ..... 347/92

FOREIGN PATENT DOCUMENTS

| | | |
|---|---|---|
| JP | 11-010899 | 1/1999 |
| JP | 11-198394 | 7/1999 |
| JP | 2004-195719 | 7/2004 |
| JP | 2005-074827 | 3/2005 |
| JP | 2005-074836 | 3/2005 |
| JP | 2006-095876 | 4/2006 |
| JP | 2006-095878 | 4/2006 |
| JP | 2007-045166 | 2/2007 |
| JP | 2007-106016 | 4/2007 |
| JP | 2008-173827 | 7/2008 |

* cited by examiner

*Primary Examiner* — Jannelle M Lebron

(74) *Attorney, Agent, or Firm* — Workman Nydegger

(57) ABSTRACT

There is provided a defoaming mechanism that is used for eliminating air bubbles from a liquid flowing through the inside of a liquid supply path included in a liquid ejecting apparatus. The defoaming mechanism includes a defoaming chamber that has a side wall extending in the vertical direction and is used for capturing the air bubbles contained in the liquid and a communication portion that allows the defoaming chamber and the liquid supply path to be communicated with each other in the side wall.

15 Claims, 7 Drawing Sheets

< AT THE TIME OF INK EJECTION >

< AFTER INFLOW OF INK >

(SECOND EMBODIMENT)

(THIRD EMBODIMENT)

(FOURTH EMBODIMENT)

(FIFTH EMBODIMENT)

(SIXTH EMBODIMENT)

DEFOAMING MECHANISM AND LIQUID EJECTING APPARATUS

CROSS REFERENCES TO RELATED APPLICATIONS

The present invention contains subject matter related to Japanese Patent Application No. 2008-224895 filed in the Japanese Patent Office on Sep. 2, 2008 and Japanese Patent Application No. 2008-224900 filed in the Japanese Patent Office on Sep. 2, 2008, the entire contents of which are incorporated herein by reference.

BACKGROUND

1. Technical Field

The present invention relates to technology for eliminating air bubbles from a liquid that flows through the inside of a liquid ejecting apparatus.

2. Related Art

In ink jet printers, there are cases where defective printing, such as dot missing, occurs when air bubbles are generated in ink located in an ink supply path that is formed from an ink supply unit such as an ink cartridge to a record head. Accordingly, the elimination of the air bubbles (defoaming) from the ink is required. As a mechanism for performing such defoaming, a mechanism in which a chamber (defoaming chamber) for capturing air bubbles by temporarily collecting the ink and a decompression chamber are located to be adjacent to each other through a partition wall having gas permeability and the air bubbles captured in the defoaming chamber are eliminated by adjusting the pressure of the decompression chamber to be lower than that of the defoaming chamber has been proposed (see, JP-A-2006-95878).

However, according to a general defoaming mechanism, there is a problem that air bubbles contained in the ink cannot be sufficiently eliminated. In addition, such problems may occur not only in ink jet printers but also in arbitrary liquid ejecting apparatuses that eject any type of liquid, such as a lubricant or a resin liquid.

SUMMARY

An advantage of some aspects of the invention is that it provides a defoaming mechanism and a liquid ejecting apparatus capable of eliminating air bubbles contained in a liquid.

The invention may be implemented in the following forms or applied examples.

APPLIED EXAMPLE 1

According to a first aspect of the invention, there is provided a defoaming mechanism that is used for eliminating air bubbles from a liquid flowing through the inside of a liquid supply path included in a liquid ejecting apparatus. The defoaming mechanism includes: a defoaming chamber that has a side wall extending in the vertical direction and is used for capturing the air bubbles contained in the liquid; and a communication portion that allows the defoaming chamber and the liquid supply path to be communicated with each other in the side wall.

According to the above-described defoaming mechanism, the liquid supply path is communicated with the side wall of the defoaming chamber through the communication portion, and accordingly, the liquid flowing into the defoaming chamber can be positioned toward the lower side, and the air bubbles can be positioned toward the upper side in accordance with buoyancy. As a result, the liquid and the air bubbles can be separated in a short time, and a great amount of the air bubbles can be eliminated in a short time.

APPLIED EXAMPLE 2

In the defoaming mechanism described in Applied Example 1, the position of the communication portion in which the side wall is connected to is higher than the position of the communication portion in which the liquid supply path is connected to.

Accordingly, backflow of the air bubbles contained in the ink, which collect in the defoaming chamber, to the liquid supply path through the communication portion can be suppressed. In other words, even when the air bubbles flow back to the communication portion, the air bubbles can be returned to the defoaming chamber in accordance with the buoyancy of the air bubbles, and accordingly, the backflow of the air bubbles to the liquid supply path can be suppressed.

APPLIED EXAMPLE 3

In the defoaming mechanism described in Applied Example 2, the communication portion has a flow path formed in an upward direction from the position of the communication portion in which the liquid supply path is connected toward the position of the communication portion in which the side wall is connected.

Accordingly, backflow of the air bubbles contained in the ink, which collect in the defoaming chamber, to the liquid supply path through the communication portion can be suppressed.

APPLIED EXAMPLE 4

In the defoaming mechanism described in Applied Example 1, the communication portion has a flow path having a cross-sectional area that is smaller than a cross-sectional area of the liquid supply path.

Accordingly, penetration of the air bubbles contained in the ink, which are collected in the defoaming chamber, into the communication portion can be suppressed.

APPLIED EXAMPLE 5

In the defoaming mechanism described in Applied Example 1, the communication portion has a flow path of a cross-sectional shape having the longitudinal direction and the direction of the area.

Accordingly, the cross-sectional area of the communication portion is configured to be large while the length of the cross-section of the communication portion in the direction of the area is configured to be smaller than the diameter (or the major axis) of the cross-section (a circle or an oval) of the air bubble, whereby the flow of the liquid can be improved.

APPLIED EXAMPLE 6

In the defoaming mechanism described in Applied Example 1, the side face of the defoaming chamber has a curved shape.

Accordingly, existence of the air bubbles on the side face of the defoaming chamber can be suppressed, and accordingly, the liquid and the air bubbles can be separated in a short time.

APPLIED EXAMPLE 7

In the defoaming mechanism described in Applied Example 1, the defoaming chamber does not have a member for absorbing the liquid therein.

Accordingly, the ink can be directly stored in the defoaming chamber, and therefore the existence of the ink inside the defoaming chamber (inside the member for absorbing the liquid) can be suppressed. In addition, since such a member is not used, the manufacturing cost of the defoaming mechanism can be suppressed. In addition, the liquid and the air bubbles can be separated by using the flow of the liquid flowing into the defoaming chamber.

APPLIED EXAMPLE 8

According to a second aspect of the invention, there is provided a defoaming mechanism that is used for eliminating air bubbles from a liquid flowing through the inside of a liquid ejecting apparatus. The defoaming mechanism includes: a defoaming chamber that has a top face, a bottom face, and a side face extending in the vertical direction and is used for capturing the air bubbles contained in the liquid; and a backflow suppression portion that suppresses the backflow of the air bubbles from the defoaming chamber to a liquid supply path by allowing the defoaming chamber and the liquid supply path located inside the liquid ejecting apparatus to be communicated with each other.

According to the above-described defoaming mechanism, the backflow suppression portion that suppresses the backflow of the air bubbles from the defoaming chamber to the liquid supply path is included, and accordingly, the backflow of the air bubbles from the defoaming chamber to the liquid supply path can be suppressed. Therefore, a greater amount of the air bubbles can be captured and eliminated in the defoaming chamber.

APPLIED EXAMPLE 9

In the defoaming mechanism described in Applied Example 8, the backflow suppression portion has a flow path that has a cross-sectional area smaller than that of the liquid supply path.

Accordingly, the cross-sectional area of the flow path of the backflow suppression portion can be configured to be small. Therefore, penetration of the air bubbles from the defoaming chamber to the backflow suppression portion can be suppressed.

APPLIED EXAMPLE 10

In the defoaming mechanism described in Applied Example 8, the backflow suppression portion has a flow path that has a cross-sectional shape having a longitudinal direction and the direction of the area.

Accordingly, as the shape of the flow path that is included in the backflow suppression portion, the length of the flow path in the direction of the area is configured to be smaller than the diameter (or the major axis) of the cross-section (a circle or an oval) of the air bubble, so that penetration of the air bubbles into the backflow suppression portion is suppressed. In addition, the cross-sectional area of the backflow suppression portion (flow path) is configured to be large, and accordingly, the flow of the liquid can be improved.

APPLIED EXAMPLE 11

In the defoaming mechanism described in Applied Example 8, the communication portion is connected to the defoaming chamber in any one of the top face, the bottom face, and the side face.

Accordingly, the connection portion can be easily formed, compared to a configuration in which the communication portion is connected to the corners of the defoaming chamber.

APPLIED EXAMPLE 12

In the defoaming mechanism described in Applied Example 11, the communication portion is connected to the defoaming chamber in a portion of the side face that is located higher than half the height of the side face.

Accordingly, the liquid flowing into the defoaming chamber can be positioned toward the lower side, and the air bubbles contained in the liquid can be positioned toward the upper side in accordance with buoyancy. As a result, the liquid and the air bubbles can be separated in a short time.

APPLIED EXAMPLE 13

According to a third aspect of the invention, there is provided a liquid ejecting apparatus that includes the defoaming mechanism described in Applied Example 8.

Accordingly, a great amount of the air bubbles can be eliminated from the liquid flowing through the inside of the liquid ejecting apparatus in a short time. Therefore, defective liquid ejection such as dot missing can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A1. Configuration of Apparatus

Figure 1:
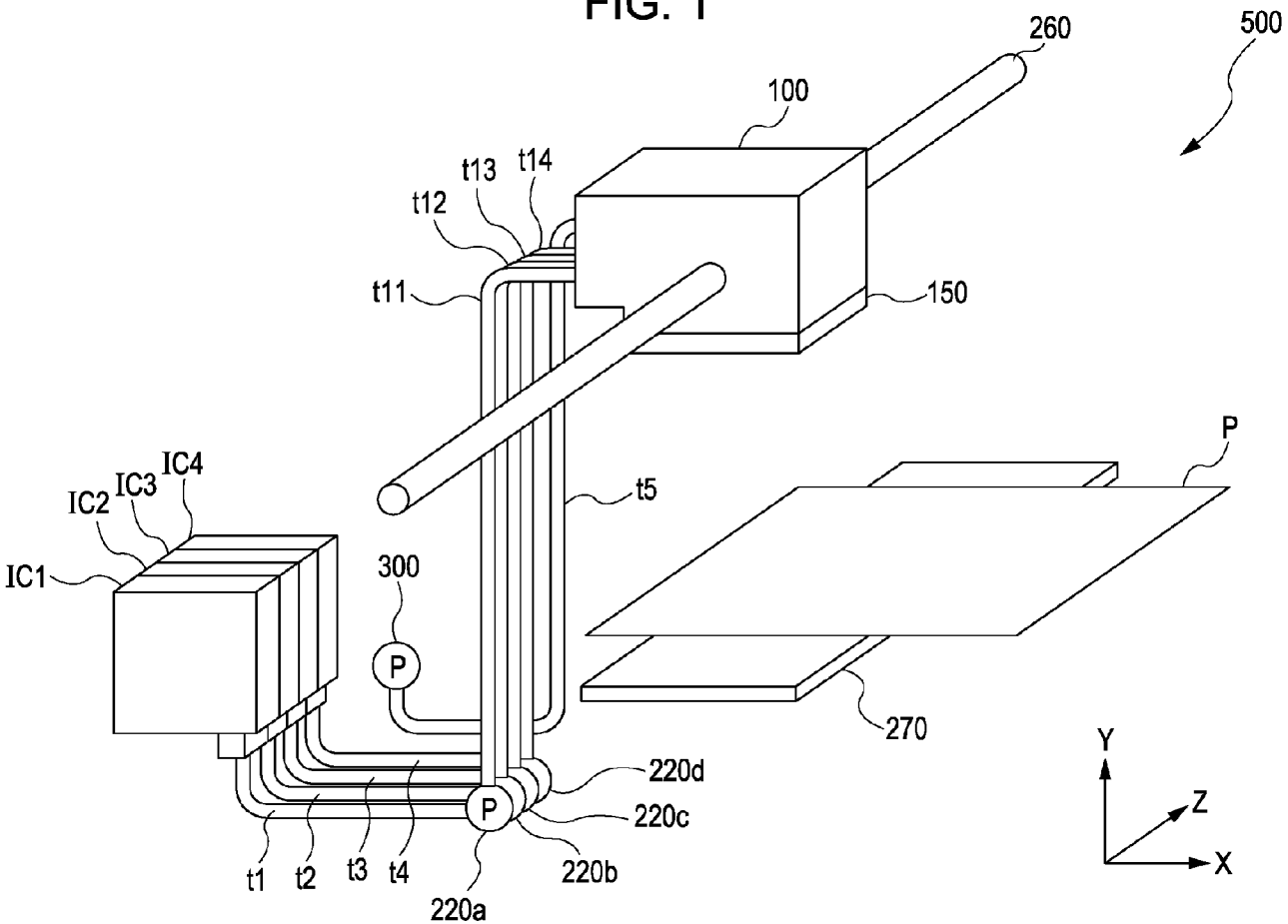
FIG. 1 is an explanatory diagram showing a schematic configuration of a printer that includes a carriage as a defoaming mechanism according to an embodiment of the invention.

FIG. 1 is an explanatory diagram showing a schematic configuration of a printer 500 that includes a carriage 100 as a defoaming mechanism according to an embodiment of the invention. The printer 500 is an ink jet printer that can eject four-colors (black, cyan, magenta, and yellow) of ink. The printer 500 includes an ink cartridge IC1 for black ink, an ink cartridge IC2 for cyan ink, an ink cartridge IC3 for magenta ink, an ink cartridge IC4 for yellow ink, a carriage 100, a record head 150, a guide rod 260, a platen 270, four ink supply pumps 220*a*, 220*b*, 220*c*, and 220*d*, and a decompression pump 300.

The printer 500 is a so-called off-carriage-type printer in which four ink cartridges IC1 to IC4 are mounted to the printer main body side. The ink cartridge IC1 is connected to the carriage 100 through a tube t1, the ink supply pump 220*a*, and a tube t11. Similarly, the ink cartridges IC2, IC3, IC4 are connected to the carriage 100 through a tube t2, the ink supply pump 220*b*, and a tube t12, through a tube t3, the ink supply pump 220*c*, and a tube t13, and through a tube t4, the ink supply pump 220*d*, and a tube 14, respectively. The decompression pump 300 is connected to the carriage 100 through a tube t5. In addition, the ink cartridges IC1 to IC4 are mounted on a main frame (not shown) of the printer 500 by a cartridge holder not shown in the figure.

The ink supply pump 220*a* supplies black ink stored in the ink cartridge IC1 to the carriage 100. Similarly, the ink supply pump 220*b* supplies cyan ink stored in the ink cartridge IC2 to the carriage 100, the ink supply pump 220*c* supplies magenta ink stored in the ink cartridge IC3 to the carriage 100, and the ink supply pump 220*d* supplies yellow ink stored in the ink cartridge IC4 to the carriage 100. The decompression pump 300 is commonly used for all the colors (black, cyan, magenta, and yellow).

The guide rod 260 is disposed on the upper side (+Y direction) of the platen 270 along the longitudinal direction (the direction parallel to a Z axis) of the platen 270. The carriage 100 is supported so as to be movable in the longitudinal direction of the platen 270 along the guide rod 260. In addition, the carriage 100 is driven through a timing belt (not shown) by a carriage motor (not shown). The record head 150 is disposed on the bottom face of the carriage 100. In addition, the record head 150 ejects ink droplets in the lower direction (−Y direction) from a plurality of nozzles (not shown) in accompaniment of a reciprocating motion of the carriage 100 in the longitudinal direction. At this moment, a recording sheet P is driven onto the platen 270 in the +X direction by a paper feeding mechanism not shown in the figure, and an image, or the like, is formed on the recording sheet P.

Figure 2A:
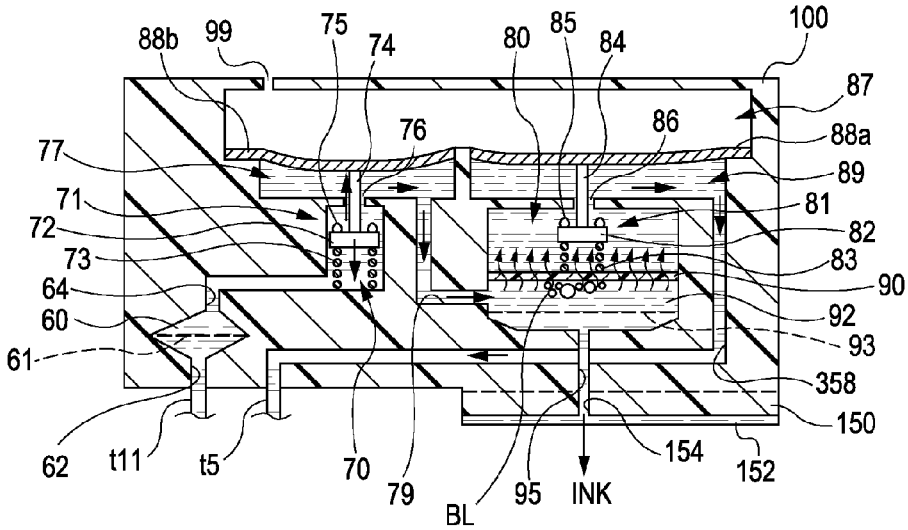
FIG. 2A is an explanatory diagram showing the state of the carriage and the record head at the time of the ejection of the ink.

FIG. 2A is an explanatory diagram showing the state of the carriage 100 and the record head 150 at the time of the ejection of the ink. FIG. 2A schematically shows the function of the carriage 100. Although the function relating to the supply of black ink is shown in FIG. 2A, the function relating to the supply of ink of another color is the same.

The carriage 100 includes a filter chamber 60, an atmospheric chamber 87, a first compression chamber 77, a first pressure-adjusting valve 71, a defoaming chamber 92, a decompression chamber 80, a second compression chamber 89, a second pressure-adjusting valve 81, three internal flow paths 62, 64, and 79 through which ink is distributed, and a negative-pressure supplying path 358.

The filter chamber 60 includes a filter 61 therein. The filter chamber 60 is used for eliminating impurities by filtering the ink that has flown therein. This filter chamber 60 is communicated with the tube t11 through the internal flow path 62. In addition, the filter chamber 60 is communicated with a valve chamber 70 to be described later through the internal flow path 64. The atmospheric chamber 87 is communicated with the atmosphere through an atmospheric communication hole 99.

The first compression chamber 77 is used for adjusting the pressure of the ink supply path inside the carriage 100 by temporarily collecting black ink. The first compression chamber 77 is adjacent to the atmospheric chamber 87 through a partition wall portion 88*b* as a ceiling portion. The partition wall portion 88*b* has flexibility and can be displaced in the vertical direction. The partition wall portion 88*b* may be configured by a film, for example, formed of a synthetic resin, rubber, or the like, and a thin plate member of a cantilever (not shown) that can displace the film. The first compression chamber 77 includes an ink inflow opening 76 and is communicated with the valve chamber 70 to be described later through the ink inflow opening 76. In addition, the first compression chamber 77 is communicated with a defoaming chamber 92 through the internal flow path 79.

The first pressure-adjusting valve 71 is used for controlling the flow of black ink. This first pressure-adjusting valve 71 includes the valve chamber 70, a valve body 72, a pressure adjusting spring 73, a sealing member 75, and a support rod 74. The valve chamber 70 is communicated with the internal flow path 64. The valve body 72 is disposed inside the valve chamber 70 and is biased to the sealing position side by the pressure adjusting spring 73. The valve body 72 can be displaced between an opening position in which the first compression chamber 77 and the valve chamber 70 are communicated with each other and a sealing position in which the first compression chamber 77 and the valve chamber 70 are not communicated with each other. In particular, when a force pressing down on the valve body 72 (suppressed pressure of the support rod 74 generated by the partition wall portion 88*b* (atmospheric pressure) and the pressure inside the first compression chamber 77) becomes stronger than a force lifting up the valve body 72 (the pressure inside the valve body 70 and the biasing force of the pressure adjusting spring 73) due to the discharge of the ink from the first compression chamber 77, the valve body 72 is displaced to the opening position. On the other hand, when the force pressing down on the valve body 72 becomes weaker than the force lifting up the valve body 72, due to inflow of ink into the first compression chamber 77, the valve body 72 is displaced to the sealing position. In addition, in the example shown in FIG. 2A, the valve body 72 is located in the opening position. The sealing member 75 is disposed on the top face of the valve body 72. The sealing member 75 seals ink so as not to flow from the valve chamber 70 to the first compression chamber 77 in a case where the valve body 72 is disposed in the sealing position. The support rod 74 is disposed over the valve chamber 70 and the first compression chamber 77. The support rod 74 has one end bonded to the valve body 72 and the other end bonded to the partition wall portion 88*b* of the first compression chamber 77.

The defoaming chamber 92 is used for capturing air bubbles by temporarily storing the ink that has flown from the internal flow path 79. This defoaming chamber 92 includes a filter 93 therein. The defoaming chamber 92 is communicated with the internal flow path 79 on the upper side of the filter 93.

In addition, the defoaming chamber 92 is also communicated with the ink ejecting flow path 95. The filter 93 has the function of capturing (trapping) the air bubbles in the ceiling portion of the defoaming chamber 92 by having the air bubbles flowing inside the ink supply path to not easily pass through the ink supply path.

The decompression chamber 80 is used for eliminating air bubbles from the ink captured in the defoaming chamber 92 by using a pressure difference between the defoaming chamber 92 and the decompression chamber 80. This decompression chamber 80 is disposed on the upper side of the defoaming chamber 92. In addition, the decompression chamber 80 is located adjacent to the defoaming chamber 92 through a partition wall portion 90 having gas permeability. This partition wall portion 90 may be configured by using a member, for example, formed from polyacetal, polypropylene, polyphenylene ether, or the like.

The second compression chamber 89 is used for supplying negative pressure, which is supplied from the decompression pump 300, to the decompression chamber 80. This second compression chamber 89 is disposed on the upper side of the compression chamber 80 and is communicated with the tube t5 through the negative-pressure supplying path 358. In addition, the second compression chamber 89 is communicated with the decompression chamber 80 through a communication hole 86. The second compression chamber 89 is located adjacent to the atmospheric chamber 87 through a partition wall portion 88*a* as a ceiling portion. In addition, the partition wall portion 88*a* has the same configuration as the above-described partition wall portion 88*b*. However, the partition wall portion 88*a* and the partition wall portion 88*b* can be independently displaced without being brought into contact with each other.

The second pressure-adjusting valve 81 is disposed over the second compression chamber 89 and the decompression chamber 80. The second pressure-adjusting valve 81 is used for controlling the supply of negative pressure from the second compression chamber 89 to the decompression chamber 80. The second pressure-adjusting valve 81 has the same configuration as the above-described first pressure-adjusting valve 71. In other words, the second pressure-adjusting valve 81 includes a valve body 82, a pressure adjusting spring 83, a sealing member 85, and a support rod 84. The valve body 82 can be displaced between an opening position in which the second compression chamber 89 and the decompression chamber 80 are communicated with each other and a sealing position in which the second compression chamber 89 and the decompression chamber 80 are not communicated with each other. The valve body 82 is biased to the sealing position side by the pressure adjusting spring 83. In the example shown in FIG. 2A, the valve body 82 is disposed in the opening position. The sealing member 85 maintains negative pressure inside the decompression chamber 80 by sealing the communication hole 86 in a case where the valve body 82 is disposed in the sealing position. The support rod 84 has one end bonded to the valve body 82 and the other end bonded to a partition wall portion 88*a*.

The record head 150 is disposed on the bottom face of the carriage 100 and ejects ink toward the recording sheet P (FIG. 1). This record head 150 includes a nozzle plate 152 and an ink ejecting flow path 154. The ink ejecting flow path 154 is communicated with the ink ejecting flow path 95 of the carriage 100 and directs the ink supplied from the defoaming chamber 92 to the nozzle plate 152. The nozzle plate 152 includes a plurality of nozzles (not shown).

The above-described printer 500 corresponds to a liquid ejecting apparatus according to an embodiment of the invention.

A2. Ink Supplying Operation of Carriage 100

When ink is consumed by being ejected from a plurality of nozzles (not shown) disposed in the nozzle plate 152 shown in FIG. 2A, the pressure of the first compression chamber 77 decreases due to a decrease in the amount of ink. Then, the pressure of the first compression chamber 77 becomes lower than the pressure (atmospheric pressure) of the atmospheric chamber 87, and the partition wall portion 88*b* is bent toward the inside of the first pressure chamber 77 so as to be displaced to the lower side. At this moment, the valve body 72 is pressed downward by the support rod 74. Then, when the valve body 72 is located in the opening position by overcoming the biasing force of the pressure adjusting spring 73, the ink inflow opening 76 is opened, and accordingly, the ink flows into the first compression chamber 77.

Figure 2B:
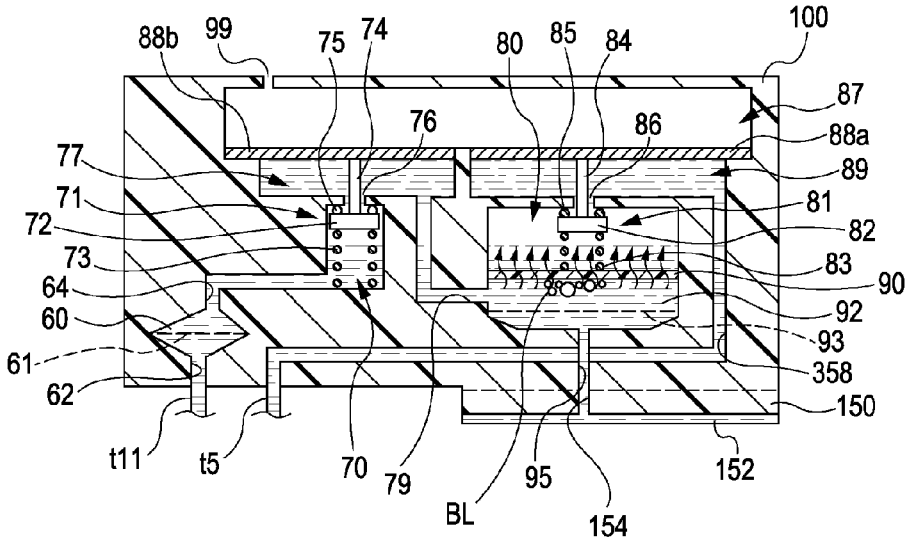
FIG. 2B is an explanatory diagram showing the state of the carriage and the record head after the ink flows into a first compression chamber from an opened ink inflow opening.

FIG. 2B is an explanatory diagram showing the state of the carriage 100 and the record head 150 after the ink flows into the first compression chamber 77 from the opened ink inflow opening 76. When the chamber pressure of the first compression chamber 77 is increased by having the ink flow into the first compression chamber 77, the partition wall portion 88*b* is disposed to the upper side. When the valve body 72 is moved to the sealing position again in accordance with the above-described displacement of the partition wall portion 88*b*, the inflow of ink into the first compression chamber 77 is stopped, and the supply of the ink to the record head 150 is stopped. As described above, the printer 500 is configured such that ink corresponding to the consumed amount appropriately flows into the record head 150 by opening or closing the first pressure-adjusting valve 71.

A3. Defoaming Operation

The negative pressure generated by the decompression pump 300 (FIG. 1) is supplied to the second compression chamber 89 through the tube t5 and a negative-pressure supplying path 358 (FIG. 2A). At this moment, the partition wall portion 88*a* is bent to the inside of the second compression chamber 89 so as to be displaced to the lower side due to a pressure difference between the pressure (negative pressure) of the second compression chamber 89 and the pressure (atmospheric pressure) of the atmospheric chamber 87. The valve body 82 is pressed down through the support rod 84. Then, when the valve body 82 is located in the opening position, the communication hole 86 is opened, and the negative pressure is supplied to the decompression chamber 80. Then, the pressure of the decompression chamber 80 becomes lower than the pressure of the defoaming chamber 92. Accordingly, the air bubbles (gas) BL that are trapped in the ceiling portion of the defoaming chamber 92 are transmitted through the partition wall portion 90 so as to flow into the decompression chamber 80 due to a pressure difference between the decompression chamber 80 and the defoaming chamber 92.

A4. Detailed Configuration of Carriage 100

Figure 3:
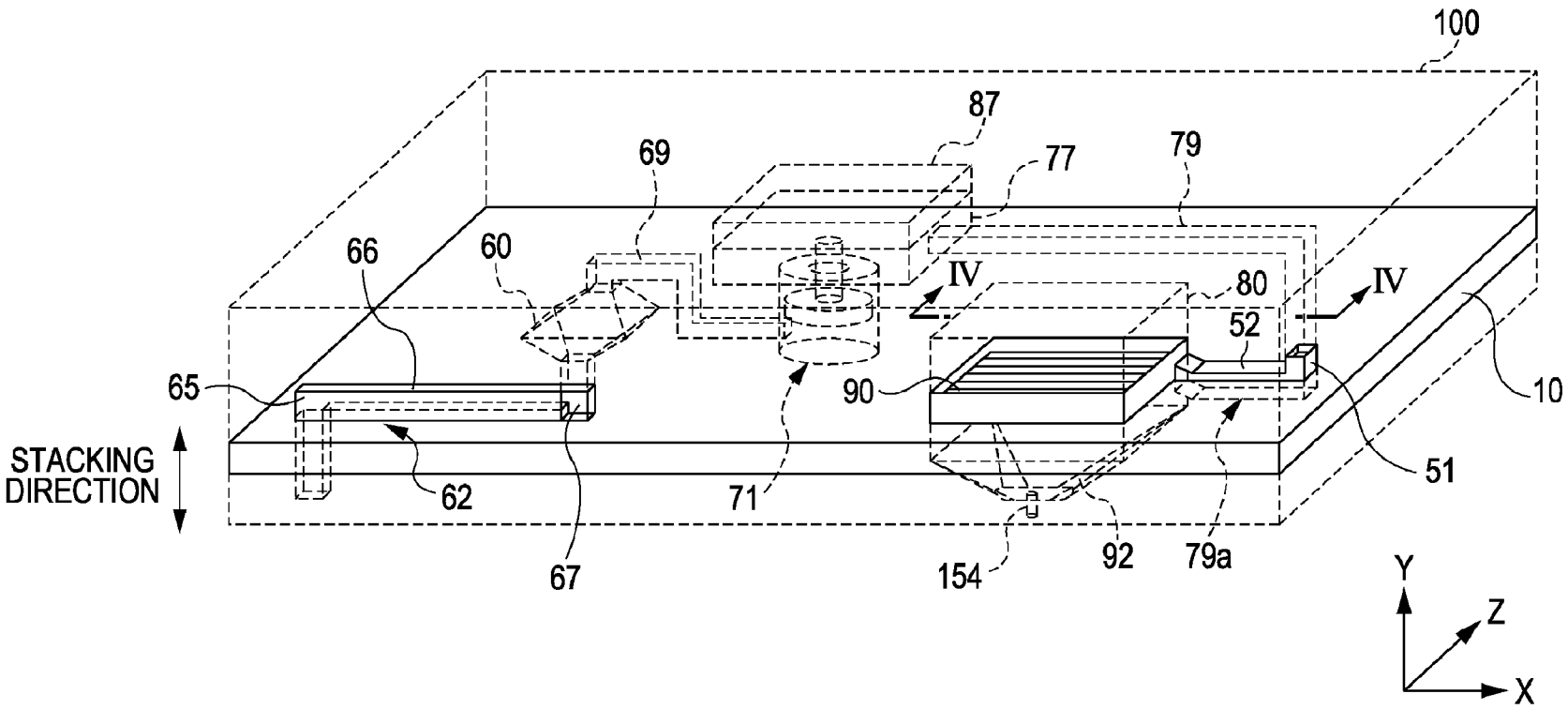
FIG. 3 is a perspective view showing a detailed configuration of the carriage.

FIG. 3 is a perspective view showing a detailed configuration of the carriage 100. In FIG. 3, for the convenience of drawing, only a configuration relating to the supply of black ink is shown. The carriage 100 having the above-described configuration (function) has a configuration in which a plurality of thin plated members (hereinafter, referred to as a "plate") is stacked in the vertical direction (Y axis). All the shapes of the faces (the stacking face: the X-Z plane) of the plurality of plates that are perpendicular to the stacking direction are rectangles having a same size. In FIG. 3, a detailed example of the partition wall plate 10 from among the plurality of stacked plates is shown, and other plates are omitted in the figure.

The partition wall plate 10 includes a partition wall portion 90, a flow path forming portion 52, and a flow path forming portion 66. The flow path forming portion 52 is a groove that is formed on the rear face of the partition wall plate 10. The flow path forming portion 52 forms a flow path 79*a* that constitutes a part of the internal flow path 79 when the partition wall plate 10 and a plate (not shown) that is brought into contact with the rear face of the partition wall plate 10 are stacked. In addition, one end of the flow path forming portion 52 (groove) is connected to the defoaming chamber 92, and the other end of the flow path forming portion 52 is connected to a through hole 51 that perforates the partition wall plate 10. The flow path forming portion 66 is a groove that is formed on the surface of the partition wall plate 10. The flow path forming portion 66 forms the internal flow path 62 when the partition wall plate 10 and a plate (not shown) that is brought into contact with the surface (an upper-side face of the stacking faces) of the partition wall plate 10 are stacked. In addition, one end of the flow path forming portion 66 is connected to a distribution hole 65 that is disposed on the rear face of the partition wall plate 10.

A5. Communication State between Internal Flow Path 79 and Defoaming Chamber 92

Figure 4:
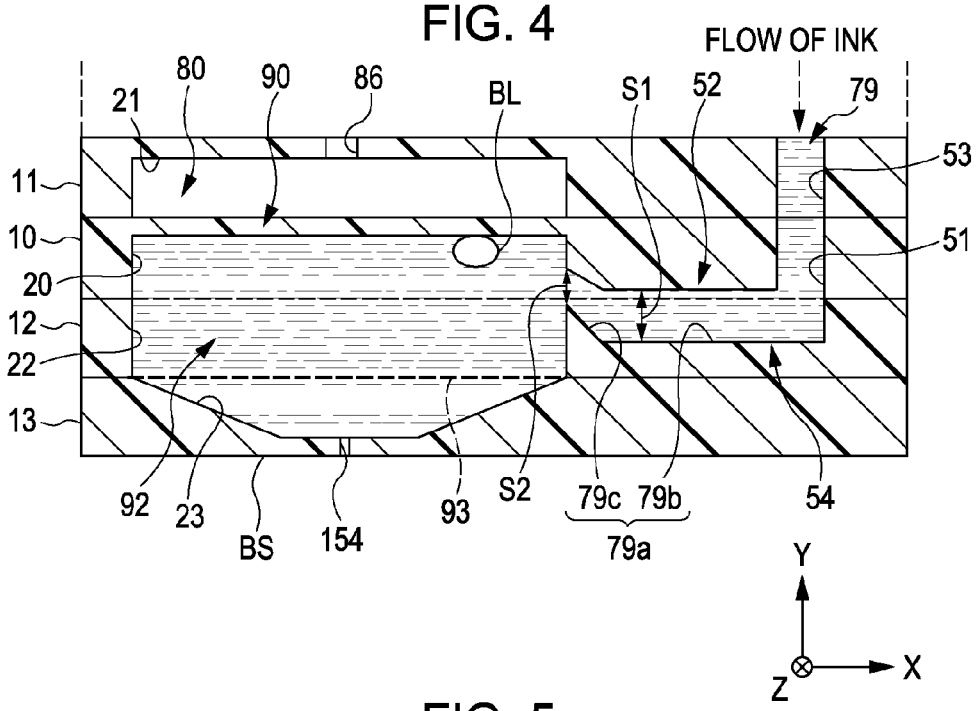
FIG. 4 is a cross-sectional view taken along line IV-IV shown in FIG. 3.

FIG. 4 is a cross-sectional view taken along line IV-IV shown in FIG. 3. In the example shown in FIG. 4, in addition to the partition wall plate 10 shown in FIG. 3, three other plates are shown.

A decompression chamber plate 11 is disposed on the upper side of the partition wall plate 10 so as to be adjacent thereto. In addition, a first defoaming chamber plate 12 is disposed on the lower side of the partition wall plate 10 so as to be adjacent thereto. A second defoaming chamber plate 13 is disposed on the lower side of the first defoaming plate 12 so as to be adjacent thereto.

The decompression chamber plate 11 includes a concave portion 21 having the lower side as an opening portion and a through hole 53 that is formed in the thickness direction (the direction along the Y axis). The partition wall plate 10 includes a concave portion 20 that is formed on the lower portion of the partition wall portion 90, the above-described through hole 51, and the above-described flow path forming portion 52. The concave portion 20 is a depressed portion in a quadrangular prism having a rectangular cross-section (X-Z cross-section). The first defoaming chamber plate 12 includes a through hole 22 that is formed in the thickness direction and a flow path forming portion 54. The flow path forming portion 54 is a groove that is formed on the surface of the upper portion of the first defoaming chamber plate 12 and extends in the direction parallel to the X axis. The second defoaming chamber plate 13 includes a concave portion 23. The concave portion 23 has a bowl shape that has an opening that is disposed on the surface of the upper portion of the second defoaming chamber plate 13 and a bottom face that is smaller than the opening. On the bottom face BS of the concave portion 23, a through hole that is used as the ink ejecting flow path 154 and is formed in the thickness direction is arranged.

By stacking the above-described four plates 10 to 13, the decompression chamber 80, the defoaming chamber 92, the internal flow path 79, and the flow path 79*a* are formed. In particular, the decompression chamber 80 is formed by the concave portion 21 and the partition wall portion 90. In addition, the defoaming chamber 92 is formed by the concave portion 20, the through hole 22, and the concave portion 23. In addition, by having two through holes 53 and 51 to be communicated with each other, a part of the internal flow path 79 is formed. In addition, the flow path forming portion 52 and the flow path forming portion 54 are disposed to face each other, and the flow path 79*a* is formed between the two flow path forming portions 52 and 54.

The flow path 79*a* includes a main flow path portion 79*b* and a communication portion 79*c*. The main flow path portion 79*b* is a flow path that extends in the direction parallel to the X axis, and one end of the main flow path portion 79*b* is connected to the through hole 51. The communication portion 79*c* is formed as a flow path formed in an upward direction from the main flow path portion 79*b* toward the defoaming chamber 92. The communication portion 79*c* allows the defoaming chamber 92 and the main flow path portion 79*b* to be communicated with each other. Here, one end of the communication portion 79*c* is connected to the side wall of the defoaming chamber 92. In addition, in the example shown in FIG. 4, the air bubbles BL are captured on the upper side of a spot in which the communication portion 79*c* and the side wall of the defoaming chamber 92 are connected together. It is preferable that the spot, in which the communication portion 79*c* and the side wall of the defoaming chamber 92 are connected together, is located on the side higher than half the height of the defoaming chamber 92 in the defoaming chamber 92. In such a case, ink flowing into the defoaming chamber 92 is turned toward the lower side, and the air bubbles contained in the ink are lifted in accordance with buoyancy, whereby separation between the ink and the air bubbles can be achieved in a short time.

The cross-section (Y-Z cross-section) of the main flow path portion 79*b* and the communication portion 79*c* is a rectangle of which the longitudinal direction is the vertical direction (the direction along the Y axis) (see FIG. 3). Here, the communication portion 79*c* (FIG. 4) is formed to be gradually thinner from the main flow path portion 79*b* toward the defoaming chamber 92. In addition, the cross-sectional area S2 in a portion in which the defoaming chamber 92 and the communication portion 79*c* are brought into contact with each other is formed to be smaller than the cross-sectional area S1 of a portion in which the main flow path portion 79*b* and the communication portion 79*c* are brought into contact with each other. Accordingly, the average cross-sectional area of the communication portion 79*c* is smaller than the cross-sectional area S1 of the main flow path portion 79*b*. In addition, it is preferable that the above-described cross-sectional area S2 is smaller than the cross-sectional area of the air bubbles that are collected and grown from the air bubbles flowing from the upstream side. For example, the above-described cross-sectional area S2 may be set to 0.5 $mm^2$.

In the example shown in FIG. 4, a large air bubble BL is captured in the concave portion 20 (the ceiling portion of the defoaming chamber 92) of the defoaming chamber 92 that is included in the partition wall plate 10. For example, this air bubble BL is formed as a plurality of minute air bubbles contained in the ink filling the defoaming chamber 92 flows from the upstream side and rises upward, and the air bubbles that have reached the ceiling portion grow in size once they collect in the ceiling portion. Here, the reason why the communication portion 79*c* is formed as the flow path formed in an upward direction from the main flow path portion 79*b* toward the defoaming chamber 92 is for preventing minute air bubbles rising inside the defoaming chamber 92 or air bubbles captured in the ceiling portion like the air bubble BL from flowing back to the internal flow path 79. In other words, even when there is an air bubble penetrated into the communication portion 79*c*, the penetrated air bubble rises in the communication portion 79*c* in accordance with buoyancy so as to return to the defoaming chamber 92, whereby a backflow of the air bubble to the main flow path portion 79*b* and the upstream side thereof can be suppressed. In addition, the reason why the cross-sectional shape of the communication portion 79*c* is a rectangle, of which the longitudinal direction is the vertical direction, is as follows. Generally, the shape of the cross-section of the air bubble BL is a circle or an oval that has the major axis in the horizontal direction. Accordingly, by forming the cross-sectional shape of the communication portion 79*c* as a rectangle that is vertically long, the length in the horizontal direction (direction of the area) is shorter than the diameter (or the major axis) of the air bubble BL. Accordingly, the flow of the ink can be improved by enlarging the cross-sectional area of the communication portion 79*c* while penetration of the air bubble BL into the communication portion 79*c* is suppressed. In addition, the reason why the average cross-sectional area of the communication portion 79*c* is smaller than the cross-sectional area S1 of the main flow path portion 79*b* is for suppressing the penetration of the air bubble BL into the communication portion 79*c* by decreasing the area of the wall face of the defoaming chamber 92 that is connected to the communication portion 79*c*. The internal flow path 79 and the main flow path portion 79*b* correspond to a liquid supply path according to an embodiment of the invention.

Figure 5:
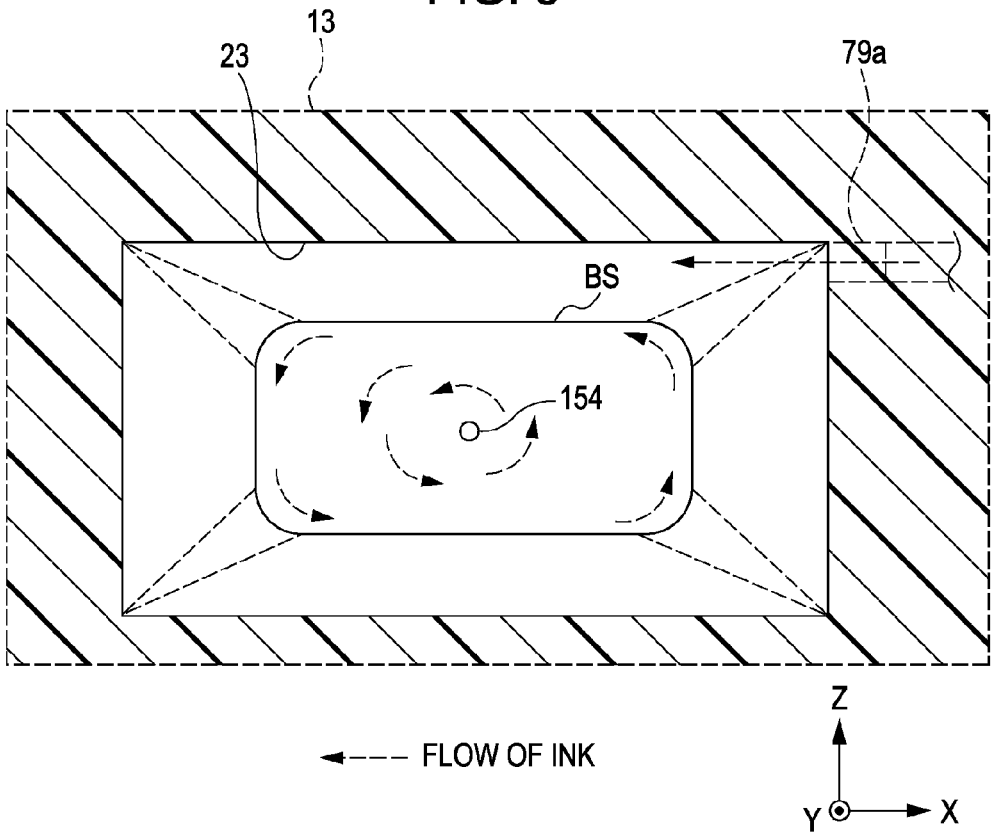
FIG. 5 is a plan view showing a detailed configuration of a concave portion of a second defoaming chamber plate shown in FIG. 4.

FIG. 5 is a plan view showing a detailed configuration of the concave portion 23 of the second defoaming chamber plate 13 shown in FIG. 4. FIG. 5 is a diagram showing the concave portion 23 viewed from the upper side. The planar shape of the bottom face BS of the concave portion 23 is not rectangular in shape but is an R shape (curved shape) having four round corners. In addition, the flow path 79*a* is disposed in a position corresponding to the upper right end of the concave portion 23. Accordingly, when ink flows into the defoaming chamber 92 from the flow path 79*a* at a high speed at the time of the initial filling of ink, or the like, the flowing ink is introduced in the −X direction and then changes direction along the wall face of the concave portion 23 so as to be turned to the lower side. In such a case, as shown in FIG. 5, the ink becomes a swirling current so as to flow into the ink ejecting flow path 154, and accordingly, the air bubbles remaining in the defoaming chamber 92 can be decreased. In addition, the radius of the curvature of the four corners in the contour of the cross-section (X-Z cross-section) of the concave portion 23 in the horizontal direction is formed so as to be large, so that the ink can face the bottom face BS in the opening portion (a portion in which the filter is disposed). Accordingly, toward the lower side of the concave portion 23, the existence of the air bubbles on the side face is suppressed, and accordingly, the air bubbles can be collected in the ceiling portion (the partition wall portion 90).

As described above, in the carriage 100, the internal flow path 79 is connected to the side wall of the defoaming chamber 92 through the flow path 79*a*. Accordingly, the ink flowing into the defoaming chamber 92 is allowed to flow from the side face toward the lower side, and the air bubbles contained in the ink can be turned to the upper side in accordance with buoyancy, whereby the ink and the air bubbles can be easily separated. Accordingly, the air bubbles contained in the ink can be collected in the ceiling portion (the partition wall portion 90) of the defoaming chamber 92 within a short time, and therefore a great amount of the air bubbles can be eliminated within a short time. In addition, since the communication portion 79*c* is formed as a flow path formed in an upward direction from the main flow path portion 79*b* toward the defoaming chamber 92, the backflow of the air bubbles located inside the defoaming chamber 92 to the main flow path portion 79*b* or the upstream side thereof (the internal flow path 79) can be suppressed. In addition, by configuring the communication portion 79*c* as the flow path formed in an upward direction as described above, the thickness (the length in the Y-axis direction) of the ceiling portion of the main flow path portion 79*b* can be configured to be large. Accordingly, evaporation of moisture from the main flow path portion 79*b* can be suppressed, whereby an increase in the viscosity of the ink can be suppressed. In addition, the cross-section of the communication portion 79*c* is configured as a rectangle, and the average cross-sectional area of the communication portion 79*c* is configured so as to be smaller than the cross-sectional area S1 of the main flow path portion 79*b*, whereby penetration of the air bubbles BL located inside the defoaming chamber 92 into the communication portion 79*c* can be suppressed. In addition, the side face of the defoaming chamber 92 has an R shape, and accordingly, the existence of the air bubbles on the side face of the defoaming chamber 92 can be suppressed. On the other hand, since the shape of the contour of the cross section (X-Z cross-section) of the ceiling portion (the partition wall portion 90) of the defoaming chamber 92 is a rectangle, the contact area between the partition wall portion 90 and the air bubbles can be increased, and the air bubbles can be allowed to stay on the four corners of the ceiling portion. In addition, the defoaming chamber 92 is configured not to be filled with an ink absorber therein but to directly store ink therein, and accordingly, it can be suppressed that the stored ink remains inside the defoaming chamber. In addition, since any ink absorber is not used, the manufacturing cost of the carriage 100 can be suppressed. Furthermore, since the ink absorber is not used, and accordingly, as shown in FIG. 5, discharge of the air bubbles by using the flow of ink flowing into the defoaming chamber 92 can be improved.

B. Second Embodiment

Figure 6:
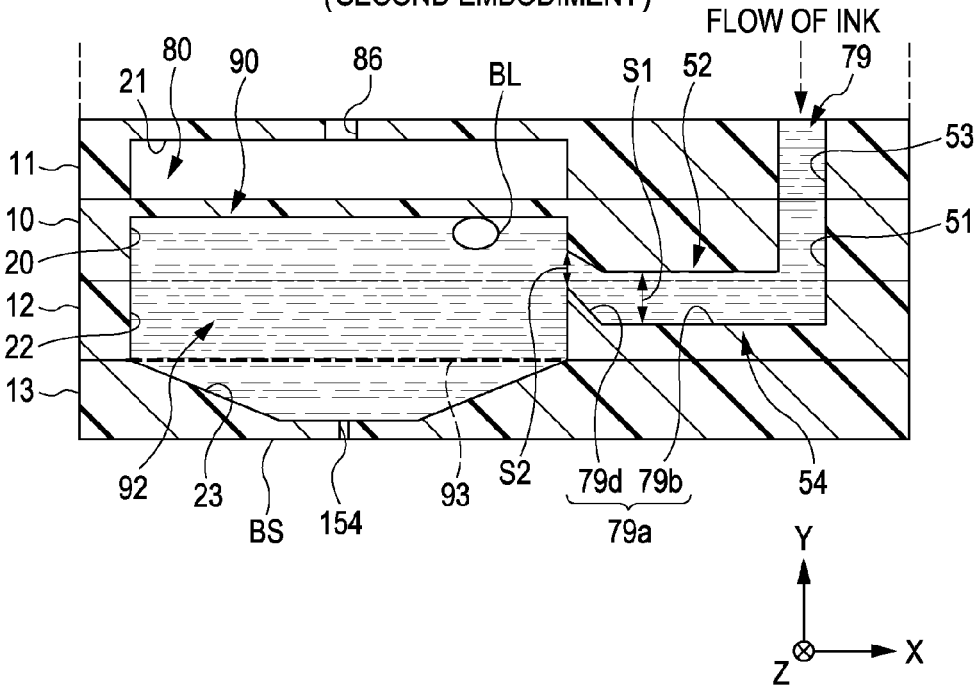
FIG. 6 is an explanatory diagram showing the stacking state of plates constituting a carriage according to a second embodiment of the invention.

FIG. 6 is an explanatory diagram showing the stacking state of plates constituting a carriage according to a second embodiment of the invention. FIG. 6 shows a cross-section taken along line IV-IV that is the same as in FIG. 4. In the carriage as a defoaming mechanism according to the second embodiment, the configuration of a communication portion is different from that of the carriage 100 (FIGS. 1 to 5), and other configurations are the same as those of the first embodiment.

In particular, the communication portion 79*c* (FIG. 4) of the first embodiment is formed so as to be thinner toward the defoaming chamber 92 from the main flow path portion 79*b*, and the cross-sectional area S2 of the portion of the communication portion 79*c* that is brought into contact with the defoaming chamber 92 is configured to be smaller than the cross-sectional area S1 (the cross-sectional area S1 of the main flow path portion 79*b*) of the portion of the communication portion 79*c* that is brought into contact with the main flow path portion 79*b*. On the contrary, the cross-sectional area of the communication portion 79*d* of the second embodiment is constant. In addition, the cross-sectional area of the communication portion 79*d* is the same as the cross-sectional area S1 of the main flow path portion 79*b*. The communication portion 79*d*, similarly to the communication portion 79*c* of the first embodiment, is formed as a flow path formed in an upward direction from the main flow path portion 79*b* toward the defoaming chamber 92.

The carriage according to the second embodiment having the above-described configuration has the same advantages as the carriage 100 according to the first embodiment.

C. Third Embodiment

Figure 7:
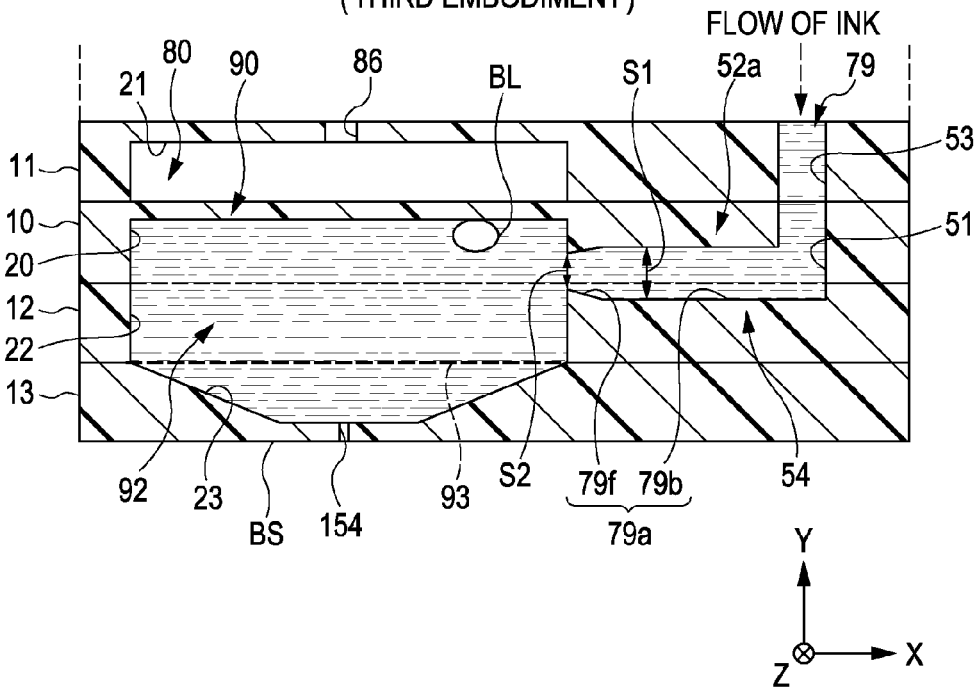
FIG. 7 is an explanatory diagram showing the stacking state of plates constituting a carriage according to a third embodiment of the invention.

FIG. 7 is an explanatory diagram showing the stacking state of plates constituting a carriage according to a third embodiment of the invention. FIG. 7 shows a cross-section taken along line IV-IV that is the same as in FIG. 4. In the carriage as a defoaming mechanism according to the third embodiment, the configuration of a communication portion is different from that of the carriage 100 (FIGS. 1 to 5), and other configurations are the same as those of the first embodiment.

In particular, the communication portion 79*c* (FIG. 4) of the first embodiment is formed as a flow path formed in an upward direction from the main flow path portion 79*b* toward the defoaming chamber 92. However, the communication portion 79*f* of the second embodiment is formed as a flow path that extends in the horizontal direction from the main flow path portion 79*b* to the defoaming chamber 92. In addition, the communication portion 79*f*, similarly to the communication portion 79*c* of the first embodiment, is formed to be gradually thinner toward the defoaming chamber 92 from the main flow path portion 79*b*.

The carriage according to the third embodiment having the above-described configuration has the same advantages as the carriage 100 according to the first embodiment.

D. Fourth Embodiment

Figure 8:
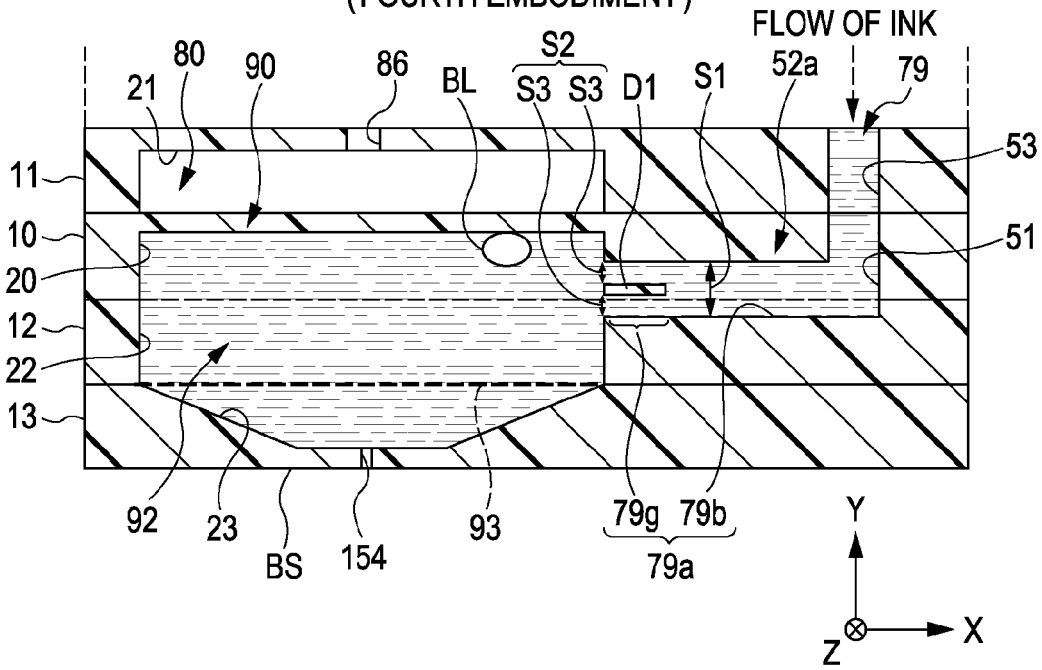
FIG. 8 is an explanatory diagram showing the stacking state of plates constituting a carriage according to a fourth embodiment of the invention.

FIG. 8 is an explanatory diagram showing the stacking state of plates constituting a carriage according to a fourth embodiment of the invention. FIG. 8 shows a cross-section taken along line IV-IV that is the same as in FIG. 4. In the carriage as a defoaming mechanism according to the fourth embodiment, the configuration of a communication portion is different from that of the carriage 100 (FIGS. 1 to 5), and other configurations are the same as those of the first embodiment.

In particular, the communication portion 79*g* of the fourth embodiment is formed as a flow path that has a division portion D1 on the center and extends in the horizontal direction. The division portion D1 divides the flow path into two in the vertical direction as an upper portion and a lower portion. Both these two flow paths have a same cross-sectional area S3, and the total cross-sectional area is the same as the cross-sectional area S2 of a contact portion between the communication portion 79*c* and the defoaming portion 92 according to the first embodiment.

The carriage according to the fourth embodiment having the above-described configuration has the same advantages as the carriage 100 according to the first embodiment. In addition, since the communication portion 79*g* divides the flow path by disposing the division portion D1, the flow of the ink can be improved by enlarging the total area of the contact faces between the defoaming chamber 92 as the internal flow path 79 and each flow path while suppressing the penetration of the air bubbles by decreasing the cross-sectional area of the contact faces between the defoaming chamber 92 and each flow path.

E. Fifth Embodiment

Figure 9:
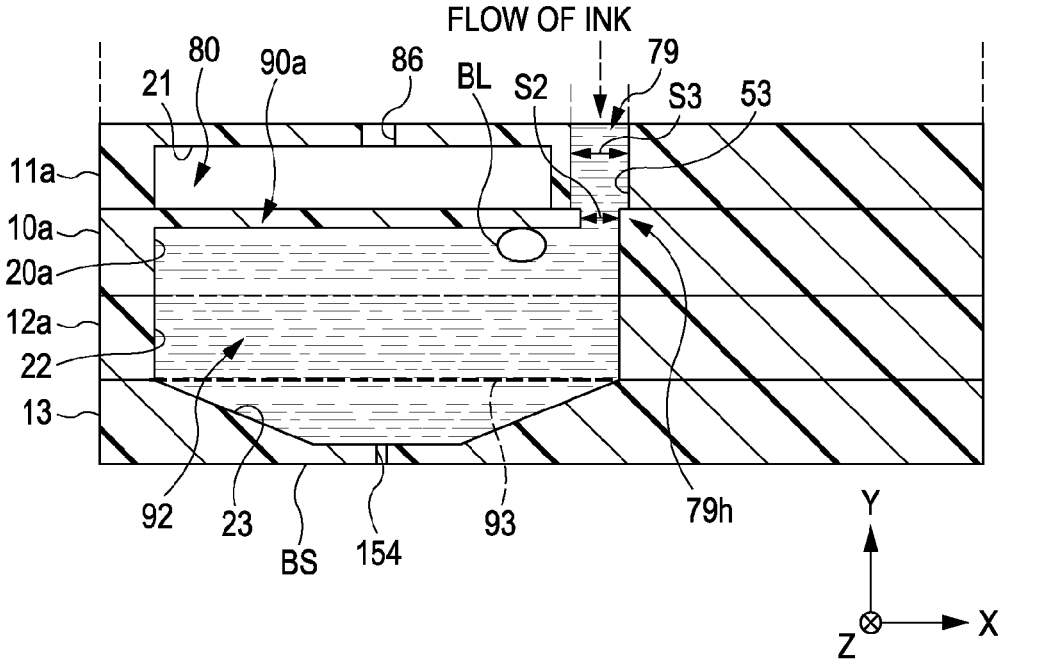
FIG. 9 is an explanatory diagram showing the stacking state of plates constituting a carriage according to a fifth embodiment of the invention.

FIG. 9 is an explanatory diagram showing the stacking state of plates constituting a carriage according to a fifth embodiment of the invention. FIG. 9 shows a cross-section taken along line IV-IV that is the same as in FIG. 4. The carriage as a defoaming mechanism according to the fifth embodiment is different from the carriage 100 (FIGS. 1 to 5) in that the main flow path portion 79*b* is not included, and the connection position of the defoaming chamber 92 with the communication portion is not the side wall but a ceiling portion. Other configurations of the carriage of the fifth embodiment are the same as those of the first embodiment.

In particular, a partition wall plate 10*a* of the fifth embodiment does not include the flow path forming portion 52. In addition, a partition wall portion 90*a* of the partition wall plate 10*a* is shorter than the partition wall portion 90 of the first embodiment in the horizontal direction, and a communication portion 79*h* is included so as to be adjacent to the partition wall portion 90*a*. This communication portion 79*h* is a through hole that is formed by perforating the partition wall plate 10*a* in the thickness direction.

A through hole 53 of a decompression chamber plate 11*a* of the fifth embodiment is disposed on the upper side of the communication portion 79*h* so as to be adjacent thereto when each plate is stacked. Accordingly, the above-described communication portion 79*h* allows the through hole 53 (the internal flow path 79) and the defoaming chamber 92 to be communicated with each other in the vertical direction (the direction parallel to the Y axis). A first defoaming chamber plate 12*a* of the fifth embodiment does not include the flow path forming portion 54. The internal flow path 79 of this embodiment corresponds to a liquid supply path according to an embodiment of the invention.

Here, the cross-section (X-Z cross-section) of the communication portion 79*h* is rectangular, and the area of the cross-section of the communication portion 79*h* is the same as the cross-section S2 of the contact portion between the communication portion 79*c* and the defoaming chamber 92 according to the first embodiment (for example, 0.5 $mm^2$). In addition, the area of the communication portion 79*h* is smaller than the cross-sectional area S3 of the through hole 53 (the internal flow path 79).

According to the carriage of the fifth embodiment having the above-described configuration, the cross-sectional area of the communication portion 79*h* is small, and thus, a large grown air bubble BL cannot easily pass through the communication portion 79*h*. Accordingly, it can be suppressed that the air bubbles contained in the ink are penetrated into the internal flow path 79 so as to flow backward, whereby a great amount of the air bubbles can be eliminated in a short time. In addition, since the shape of the cross-section of the communication portion 79*h* is rectangular, the cross-section of the communication portion 79*h* at least in the direction of the area can be configured to be shorter than the diameter of the air bubble BL. Accordingly, penetration of the air bubbles BL into the communication portion 79*c* can be suppressed.

F. Sixth Embodiment

Figure 10:
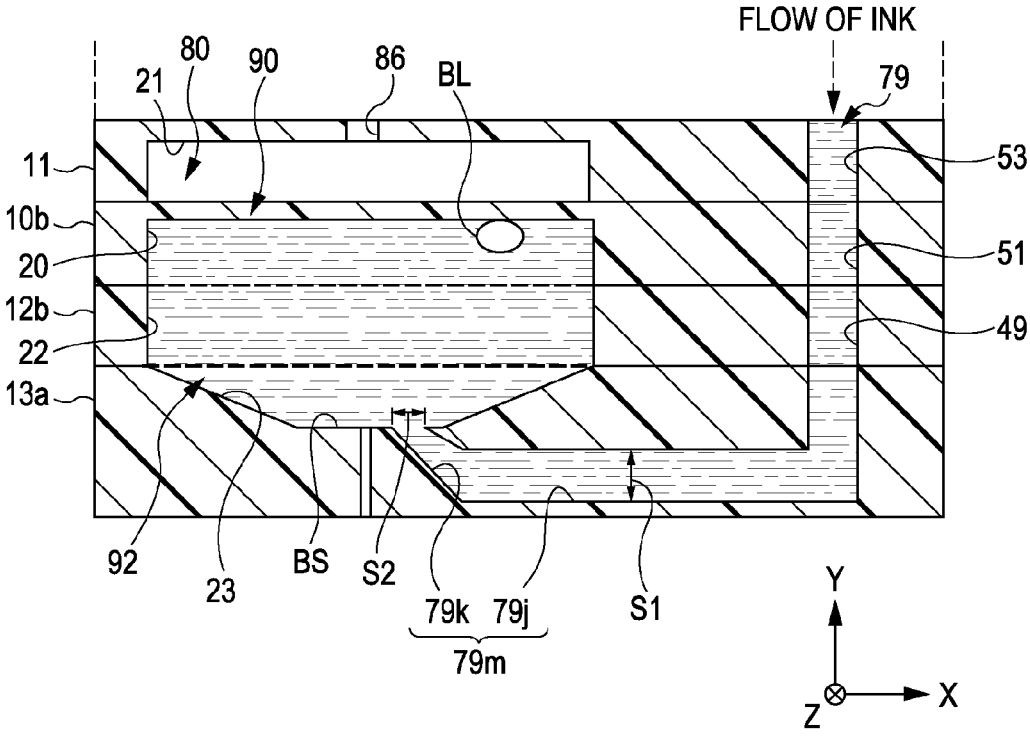
FIG. 10 is an explanatory diagram showing the stacking state of plates constituting a carriage according to a sixth embodiment of the invention.

FIG. 10 is an explanatory diagram showing the stacking state of plates constituting a carriage according to a sixth embodiment of the invention. FIG. 10 shows a cross-section taken along line IV-IV that is the same as in FIG. 4. The carriage as a defoaming mechanism according to the sixth embodiment is different from the carriage 100 (FIGS. 1 to 5) in that the connection position of the defoaming chamber 92 with the communication portion is not the side wall but the bottom face BS, and other configurations are the same as those of the first embodiment.

In particular, a partition wall plate 10*b* of the sixth embodiment does not include the flow path forming portion 52. A first defoaming chamber plate 12*b* of the sixth embodiment does not include the flow path forming portion 54. In addition, the first defoaming chamber plate 12*b* has a through hole 49 that is formed in the thickness direction. When the plates are stacked, through holes 53, 51, and 49 are communicated with one another so as to form a part of an internal flow path 79.

A second defoaming chamber plate 13*a* of the sixth embodiment includes a flow path 79*m*. This flow path 79*m*, similarly to the flow path 79*a* of the first embodiment, configures a part of the internal flow path 79. The flow path 79*m* includes a main flow path portion 79*j* and a communication portion 79*k*. The main flow path portion 79*j* is a flow path that is bent in the shape of a letter "L", and one end of the main flow path portion 79*j* reaches the surface of the upper portion of the second defoaming plate 13*a*. Then, when the plates are stacked, the main flow path portion 79*j* is communicated with the internal flow path 79 (the through hole 49).

The communication portion 79*k* allows the defoaming chamber 92 and the main flow path portion 79*j* to be communicated with each other. One end of the communication portion 79*k* is connected to the main flow path portion 79*j*, and the other end of the communication portion 79*k* is connected to the bottom face BS of the defoaming chamber 92. The communication portion 79*k*, similarly to the communication portion 79*c* of the first embodiment, is formed as a flow path formed in an upward direction from the main flow path portion 79*j* toward the defoaming chamber 92 (the bottom face BS). In addition, the communication portion 79*k* is formed to be gradually thinner toward the defoaming chamber 92 from the main flow path portion 79*j*, and the cross-sectional area S2 of a portion of the communication portion 79*k*, that is brought into contact with the defoaming chamber 92, is configured to be smaller than the cross-sectional area S1 of a portion of the communication portion 79*k* that is brought into contact with the main flow path portion 79*j*. Accordingly, the average cross-sectional area of the communication portion 79*k* is smaller than the cross-sectional area S1 of the main flow path portion 79*j*. In addition, for example, the above-described cross-section S2, similarly to the first embodiment, may be set to 0.5 $mm^2$.

The carriage according to the sixth embodiment having the above-described configuration has the same advantages as the carriage 100 according to first embodiment.

G. Modified Examples

In addition, elements from among constituent elements, which have been described in each of the above-described embodiments, other than elements claimed in an independent claim are not essential elements and may be appropriately omitted. In addition, the invention is not limited to the above-described embodiments or examples and may be implemented in various forms within the scope of the invention without departing from the basic idea. For example, the following modifications can be made therein.

G1. Modified Example 1

In each of the above-described embodiments, the shape of the cross-sections of the communication portions 79*c*, 79*d*, 79*f*, and 79*g* is rectangular of which the longitudinal direction is the vertical direction. However, the shape of the cross-sections may be configured as a rectangle of which the longitudinal direction is the horizontal direction. Furthermore, the shape of the cross-sections may be any arbitrary shape that has the longitudinal direction and the direction of the area such as a triangle or a pentagon instead of the rectangle. In such a case, the penetration of the air bubbles BL into the communication portion from the defoaming chamber 92 can be suppressed. Moreover, the above-described shape of the cross-section may be configured as any arbitrary shape that does not have the longitudinal direction and the direction of the area such as a square or a circle.

G2. Modified Example 2

In each of the above-described embodiments, the bottom portion of the defoaming chamber 92 has the R shape. However, instead of the R shape, the bottom portion may be configured to have a shape (for example, a square pillar shape) having acute angle portions. In addition, it may be configured that a member for absorbing the ink is filled inside the defoaming chamber, and ink is stored by being absorbed in the ink absorbing member.

G3. Modified Example 3

In each of the above-described embodiments, the portion between the decompression chamber 80 and the defoaming chamber 92 that has gas permeability is integrally formed as the partition wall portions 90 and 90*a*. However, it may be configured that the bottom face of the decompression chamber 80 and the ceiling face of the defoaming chamber 92 are formed as separate walls having gas permeability, and the walls are brought into contact with each other when the plurality of plates is stacked. In addition, the boundary positions of the plates are not limited to the positions shown in each embodiment and may be set to any arbitrary positions. In addition, the number of plates that constitute the carriage may be an arbitrary value. For example, the total number of plates that form the defoaming chamber 92 is three in each of the above-described embodiments. However, the total number of plates may be configured as four.

G4. Modified Example 4

In the above-described first embodiment, the connection position of the side wall (side face) of the defoaming chamber 92 with the communication portion is higher than half the height of the side face of the defoaming chamber 92. However, the connection position may be a position that is equal to or lower than half the height of the side face of the defoaming chamber 92. In addition, in each embodiment, the connection position (connection face) of the defoaming chamber 92 with the communication portion is one of the side wall (side face), the top face, and the bottom face. However, the connection position of the defoaming chamber 92 with the communication portion may be configured as a corner of the defoaming chamber 92. In addition, a configuration in which a plurality of faces of the defoaming chamber 92 is connected to the communication portion such as a configuration in which the communication portions are disposed on the side face and the top face of the defoaming chamber 92 may be used. In such a case, the communication portions 79*c*, 79*d*, 79*f*, 79*g*, 79*h*, 79*k* of each of the above-described embodiments may be used in a combining manner.

G5. Modified Example 5

In each of the above-described embodiments, the types of ink ejected by the printer 500 are in four colors. However, instead of such a configuration, a configuration in which ink of an arbitrary number of types is ejected may be used. In addition, the printer according to each of the above-described embodiments is an off-carriage-type printer. However, instead of such a configuration, a so-called on-carriage-type printer in which the ink cartridge is mounted on the carriage may be used.

G6. Modified Example 6

In the above-described first embodiment, the communication portion 79*c* is a flow path formed in an upward direction that monotonously increases in height from the main flow path portion 79*b* toward the defoaming chamber 92. However, the communication portion 79*c* may be configured as a flow path formed in an upward direction that increases in height in the shape of stairs. In addition, the communication portion 79*c* may be configured as a flow path that is bent in a concave shape or a convex shape toward the defoaming chamber 92 from the main flow path portion 79*b*. In other words, generally, as the communication portion 79*c*, a flow path having any arbitrary shape of which the connection position of the communication portion 79*c* with the defoaming chamber 92 (the side wall thereof) is higher than the connection position of the communication portion 79*c* with the main flow path portion 79*b* may be used in a defoaming mechanism according to an embodiment of the invention.

G7. Modified Example 7

In each of the above-described embodiments, examples that are applied to the carriages as the defoaming mechanism of the printer 500 have been shown. However, instead of such a configuration, a defoaming mechanism may be configured separately from the carriage. For example, in each of the above-described embodiments, a defoaming mechanism may be configured by disposing the defoaming chamber and the decompression chamber in the middle of the tubes t11 to t14. Even under such a configuration, by configuring the communication portion that allows the tubes t11 to t14 and the defoaming chambers to be communicated with each other as in each of the above-described embodiments, a great amount of air bubbles can be eliminated in a short time.

G8. Modified Example 8

In each of the above-described embodiments, an ink jet printer has been described. However, the invention is not limited thereto and may be applied to any arbitrary liquid ejecting apparatus that ejects a liquid other than ink. For example, the invention may be applied to an image recording apparatus such as a facsimile; a coloring material ejecting head that is used for manufacturing a color filter of a liquid crystal display, or the like; an electrode material ejecting apparatus that is used for forming the electrode of an organic EL (electroluminescence) display, an FED (field emission display), or the like; a liquid ejecting apparatus that ejects a liquid containing a bioorganic material that is used for manufacturing a bio chip; a test material ejecting apparatus as a precision pipette; a lubricant ejecting apparatus; a resin-solution ejecting apparatus; or the like. In addition, the invention may be applied to: a liquid ejecting apparatus that ejects a lubricant to a precision machine such as a clock or a camera in a pin-point manner; a liquid ejecting apparatus that ejects a transparent resin solution such as an ultraviolet-curable resin onto a substrate for forming a tiny hemispherical lens (optical lens) used in an optical communication element, or the like; or a liquid ejecting apparatus that ejects an acid etching solution, alkali etching solution, or the like, for etching a substrate, or the like. Furthermore, the invention may be applied to any one of various liquid ejecting apparatuses that include a liquid ejecting head that ejects tiny amounts of liquid droplets, or the like.

Here, the liquid droplets represent the shape of the liquid ejected from the liquid ejecting apparatus and include the shape of a particle, a tear, or a lengthy piece of string. In addition, the liquid described here represents a material that the liquid ejecting apparatus can eject. For example, the liquid may be a material in the liquid phase and includes a liquid state having high or low viscosity, a material in the fluid phase such as sol, gel water, other inorganic solvent, organic solvent, a liquid solution, a liquid resin, or liquid metal (metal melt). In addition, the liquid includes not only a liquid as one phase of a material but also a material in which particles of a function material formed of a solid material such as a pigment or a metal particle is dissolved, dispersed, or mixed as a solvent. As major examples of the liquid, ink and liquid crystals are described in the embodiments above. Here, the ink includes general water-based ink, oil-based ink, and various types of liquid compositions such as gel ink or hot-melt ink.

What is claimed is:

1. A defoaming mechanism that is used for eliminating air bubbles from a liquid, the defoaming mechanism comprising:

a liquid supply path which supplies the liquid;

a defoaming chamber that has a side wall extending in the vertical direction and is used for capturing the air bubbles contained in the liquid; and a communication portion that allows the defoaming chamber and the liquid supply path to be communicated with each other, the communication portion connected to the side wall or a bottom face of the defoaming chamber, the communication portion having a first slope extending upward toward the side wall or the bottom face from a bottom face of the liquid supply path and a second slope extending upward toward the side wall or the bottom face from a top face of the liquid supply path opposed to the bottom face of the liquid supply path, the communication portion having a first portion that is connected to the defoaming chamber and a second portion that is connected to the liquid supply path, wherein a cross-section of the first portion is smaller than a cross-section of the second portion.

2. The defoaming mechanism according to claim 1, wherein the side face of the defoaming chamber has a curved shape.

3. The defoaming mechanism according to claim 1, wherein the defoaming chamber does not have a member for absorbing the liquid therein.

4. A liquid ejecting apparatus comprising the defoaming mechanism according to claim 1.

5. The defoaming mechanism according to claim 1, wherein the communication portion suppresses the backflow of the air bubbles from the defoaming chamber to the liquid supply path.

6. The defoaming mechanism according to claim 1, wherein the communication portion has a flow path that has a cross-sectional shape having a longitudinal direction.

7. The defoaming mechanism according to claim 1, wherein the first slope and the second slope of the communication portion make a cross-section of the communication portion smaller than the cross-section of the liquid supply path gradually.

8. The defoaming mechanism according to claim 1, wherein the position of the communication portion in which the side wall is connected to is higher than the position of a half of a height of the defoaming chamber.

9. The defoaming mechanism according to claim 1, wherein the position of the communication portion in which the side wall or the bottom face is connected to is higher than the position of the communication portion in which the liquid supply path is connected to.

10. The defoaming mechanism according to claim 9, wherein the communication portion has a flow path formed in an upward direction from the position of the communication portion in which the liquid supply path is connected toward the position of the communication portion in which the side wall is connected.

11. The defoaming mechanism that is used for eliminating air bubbles from a liquid, the defoaming mechanism comprising:

a liquid supply path which supplies the liquid;

a defoaming chamber that has a bottom face and is used for capturing the air bubbles contained in the liquid; and a communication portion that allows the defoaming chamber and the liquid supply path to communicate with each other, the communication portion being connected to the bottom face of the defoaming chamber, the communication portion having a slope that makes a cross-section of the communication portion smaller than a cross-section of the liquid supply path gradually, the slope extending up towards the bottom face of the defoaming chamber from a bottom face of the liquid supply path.

12. The defoaming mechanism according to claim 11, wherein the communication portion suppresses the backflow of the air bubbles from the defoaming chamber to the liquid supply path.

13. The defoaming mechanism according to claim 11, wherein the position of the communication portion to which the bottom face is connected is higher than the position of the bottom of the liquid supply path.

14. The defoaming mechanism according to claim 11, wherein the communication portion has a flow path that has a cross-sectional shape having a longitudinal direction.

15. A liquid ejecting apparatus comprising the defoaming mechanism according to claim 11.

* * * * *